US005333348A

United States Patent [19]

Schumacher, II et al.

[11] Patent Number: 5,333,348

[45] Date of Patent: Aug. 2, 1994

[54] SMOOTHING TOOL HANDLE MOUNTING ASSEMBLY

[76] Inventors: Gustav Schumacher, II; Günther Schumacher, both of Gartenstrasse 8, D-5231 Eichelhardt, Fed. Rep. of Germany

[21] Appl. No.: 986,857

[22] Filed: Dec. 4, 1992

[30] Foreign Application Priority Data

Dec. 6, 1991 [DE] Fed. Rep. of Germany ..... 4140278

[51] Int. Cl.[5] ..... B05C 17/10; B06F 75/34; E04F 21/16

[52] U.S. Cl. ..... 15/235.4; 15/145; 38/92; 16/114 R

[58] Field of Search ..... 38/69, 90, 91, 92; 15/145, 145 R, 235.4–235.8; 16/110 R, 114 R; 403/384; 172/371, 372; 81/489; 7/114

[56] References Cited

U.S. PATENT DOCUMENTS

| | | | |
|---|---|---|---|
| 23,910 | 5/1859 | Ellison | 38/92 |
| 212,643 | 2/1879 | Ashton et al. | 38/92 |
| 337,297 | 1/1888 | Fischer | 38/92 |
| 1,210,100 | 12/1916 | Pottorf | 172/372 |
| 1,609,704 | 12/1926 | Ellis | 15/235.4 |
| 3,010,133 | 11/1961 | Hurd | 15/235.4 |
| 3,346,905 | 10/1967 | Scarpelli | 15/235.6 |
| 4,399,583 | 8/1983 | Jarvis | 15/235.8 |
| 4,817,231 | 4/1989 | Ocwieja | 15/235.4 |
| 4,915,610 | 4/1990 | Curry | 15/235.4 X |
| 4,958,399 | 9/1990 | Toal et al. | 15/235.4 X |
| 5,160,748 | 11/1992 | Gauuan | 15/235.4 X |

FOREIGN PATENT DOCUMENTS

| | | | |
|---|---|---|---|
| 2540885 | 3/1977 | Fed. Rep. of Germany | 15/235.4 |
| 2700739 | 10/1987 | Fed. Rep. of Germany . | |
| 0741487 | 12/1955 | United Kingdom . | |

*Primary Examiner*—Clifford D. Crowder
*Assistant Examiner*—Ismael Izaguirre
*Attorney, Agent, or Firm*—Harness, Dickey & Pierce

[57] ABSTRACT

A distributing and smoothing tool has a grip (2) releasably connected to a trowel blade (1). A fastening rail (10) has a top hat shape, in cross section, with outwardly bent flanges (14,15) which rest on the upper face (16) of the trowel blade (1). The flanges (14, 15) are connected to the upper face (16) by rows of spot welds (17,18), one row along each flange. The grip (2) is supported by a grip base (5), which is appropriately formed in a U-shape in cross section, and positioned on the fastening rail (10). The end faces (26,27) of the limbs (6,7) of the grip base (5) are supported on the faces of the flanges (14,15) away from the trowel blade 1. An attachment (19) of the fastening rail (10), engages into a recess (20) of the grip base (5), and a knurled screw (23) engages into a threaded borehole (21) of the fastening rail (10) and secures to the grip base (5).

10 Claims, 1 Drawing Sheet

SMOOTHING TOOL HANDLE MOUNTING ASSEMBLY

BACKGROUND OF THE INVENTION

1. Field of the Invention

The present invention relates to a distributing and smoothing tool and, in particular, to a tool with a trowel blade and a grip for bricklayers, plasterers and painters. A fastening rail is attached to the upper face of the trowel blade away from the smoothing and distributing face. The fastening rail extends in the longitudinal direction of the trowel blade. The rail, in cross section, has a web facing the grip and limbs issuing from the web, extending in parallel and directed towards the upper face of the trowel blade. The grip includes a groove in its base which engages over the fastening rail. The grip is releasably fastened to the rail by way of fastening means.

2. Description of the Prior Art

A distributing and smoothing tool is described in DE 27 00 739 C2, issued on Oct. 22, 1987. A U-section serves as the fastening rail. The U-section is attached with its limbs downwards to a trowel blade, consisting of steel plate, and is fixed by rivets. The rivets, usually four of them, are in this respect welded to the trowel blade and guided through boreholes of the rail in such a way that the rail is securely connected to the trowel blade. A grip is releasably connected to the rail. The grip can be set in one or the other of two positions 180 degrees apart. Also, the grip may fastened to the fastening rail in positions displaced from one another in the longitudinal direction. In this way, the trowel blade may be better utilized, for it is subject to constant wear during operation.

The grip itself includes the handle with a front downwardly angular region and it is formed in one piece with a grip-base part reaching to the front and back. The rear grip-base part formed under the handle in this respect has an integrally molded recess, into which engages a lug-like attachment of the U-rail mounted on the trowel blade. The front grip-base region is releasably secured by a screw to the U-rail. Since two screws, or two threads are provided in a mirrored manner from the center of the U-shaped fastening rail and the lug-like attachment mentioned above is integrally molded to each end of the fastening rail, the grip can be selectively fixed in positions displaced by 180 degrees from one another.

Although the described type of fastening of the grip has proven satisfactory, disadvantages result from this type of fastening of the fastening rail to the trowel blade. One disadvantage is the rivets, four of which are used according to the exemplary embodiment described, are welded individually onto the trowel blade and the fastening rail is then attached and the rivets closed. This is relatively time-consuming. Also, it is very disadvantageous that the very thin trowel blade, preferably consisting of elastic steel, braces during the rivetting procedure. The blade does not remain straight, but becomes corrugated, impairing the result of the work during use.

However, the greatest disadvantage is that the grip base is laterally supported next to the limbs of the fastening rail directly on the upper face of the trowel blade. The latter presses downwards on both sides of the fastening rail about the welding connection points of the rivets when the grip is made fast by screwing. The trowel blade in the process is deformed into a concave shape which likewise has a disturbing effect during use. If, during use, the trowel blade is loaded on one side, the grip base, which engages around the fastening rail and is likewise U-shaped in cross section, presses with the loaded limb directly on to the trowel blade. Since the trowel blade can give slightly, due to the rivets welded centrally in a row, the grip is not laterally connected to the trowel blade in a sufficiently stable manner. This, indeed only slight and resilient movement of the grip, is likewise disturbing during work.

Thus, it is desirable to improve the connection between the grip and trowel blade, without abandoning the fastening of the grip to the fastening rail, in such a way to achieve a stable holding of the trowel blade.

SUMMARY OF THE INVENTION

According to the present invention a distributing and smoothing tool is provided which overcomes the above disadvantages. The tool includes a trowel blade, with a first smoothing and distributing face and a second face remote from said first face, a grip, and a fastening rail secured to the second face of the trowel blade and extending in the longitudinal direction of the trowel blade. The fastening rail is of a top hat shape, in cross section, with a web facing the grip. Parallel limbs extend from the web and are directed towards the second face of the trowel blade. Flanges extend outwardly from the ends of the limbs remote from the web. Each of the flanges are welded to said second face of the trowel blade. The grip has a base with a groove to engage over the fastening rail. Fastening means is included to releasably fasten the grip base to the fastening rail.

In this construction it is advantageous, in contrast with the type of fastening in accordance with the prior art where the rivets are arranged in a single line on the longitudinal axis of the trowel blade, to provide two fastening lines, one along each flange, which are separated and spaced apart from one another. The construction of the section of the fastening rail and the fastening of the fastening rail lead to the non-occurrence of bracings of the trowel blade. In addition to this, by means of the two-row fastening of the fastening rail on the trowel blade, an increased lateral stability is attained to guide the trowel blade when it is employed. Compared with the single row of fastening rivets, a further advantage is an increased endurance limit. The single row riveting subjects itself to the additional disadvantage of the rivets being strained during bending. When the smoothing trowel in accordance with the invention is employed, only upwardly directed pulls arise on the welding line lying opposite the loading direction. This type of loading leads to the prevention of a breaking-out of the spot welds from the trowel blade.

Furthermore, however, significant advantages also arise in production. The rivets which are cost-intensive per se are quite superfluous and eliminated. The closing of the rivets is omitted. In this way as a whole the manufacturing costs are reduced. Moreover, the vertical stability is increased, which results from the greater stability of the section of the fastening rail.

In a further development the base of the grip is supported on the flanges of the fastening rail in the mounted state. The fastening of the grip to the fastening rail does not exert any negative influence on the connection between the fastening rail and trowel blade. In this way no bracings occur through the fastening of the grip base. Thus, the grip base is not directly supported on the trowel blade, but on the edges of the fastening rail. Therefore, no loading is introduced from the fixing of the grip onto the trowel blade.

In a further development of the invention, the flanges extend over the entire length of the fastening rail.

For the fastening of the fastening rail, preferably, the flanges are discontinuously welded to the trowel blade. Spot welding is preferred. A particularly favorable connection results if the flanges are connected to the trowel blade by means of a projection welded seam. In this respect the projections of the seam are associated with the flanges. The welding of the fastening rail to the trowel blade by spot welding, in particular by projection welding, results in a significantly more stable connection due to a greater number of spot-weld connections provided than is possible with rivets. The welding procedure does not take more time than the welding of a single rivet in the solution provided in accordance with the prior art. Since, in the known prior art, in each case several rivets are to be welded, with the solution according to the invention, a considerably shorter period for the production of the connection is required.

The flanges preferably extend so that they are aligned parallel to the upper face of the trowel blade and abut it in an areal manner.

From the following detailed description taken in conjunction with the accompanying drawings and subjoined claims, other objects and advantages of the present invention will become apparent to those skilled in the art.

BRIEF DESCRIPTION OF THE DRAWINGS

For a better understanding of the invention and to show how the same may be carried into effect, reference will now be made, by way of example, to the accompanying drawing, in which.

DETAILED DESCRIPTION OF THE PREFERRED EMBODIMENT

Figure 1:
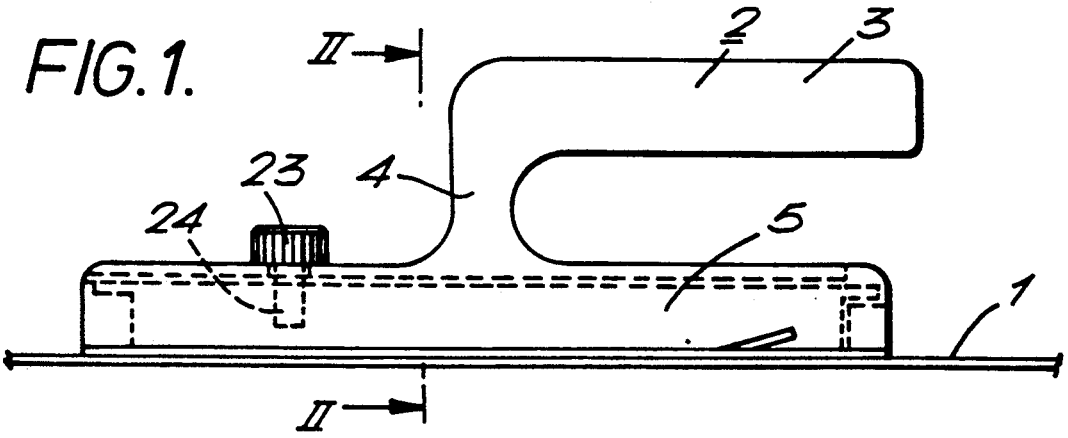
FIG. 1 is a side elevational schematic view of a distributing and smoothing tool in accordance with the present invention.
Figure 2:
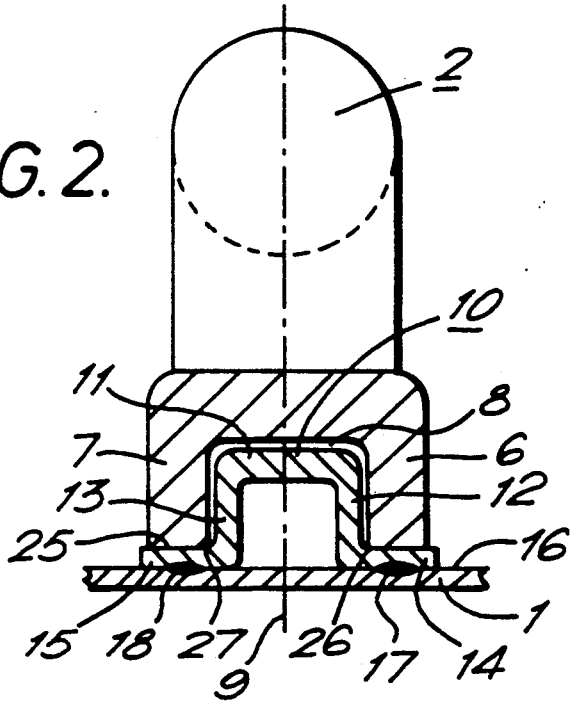
FIG. 2 is a section taken on line II—II in FIG. 1.
Figure 3:
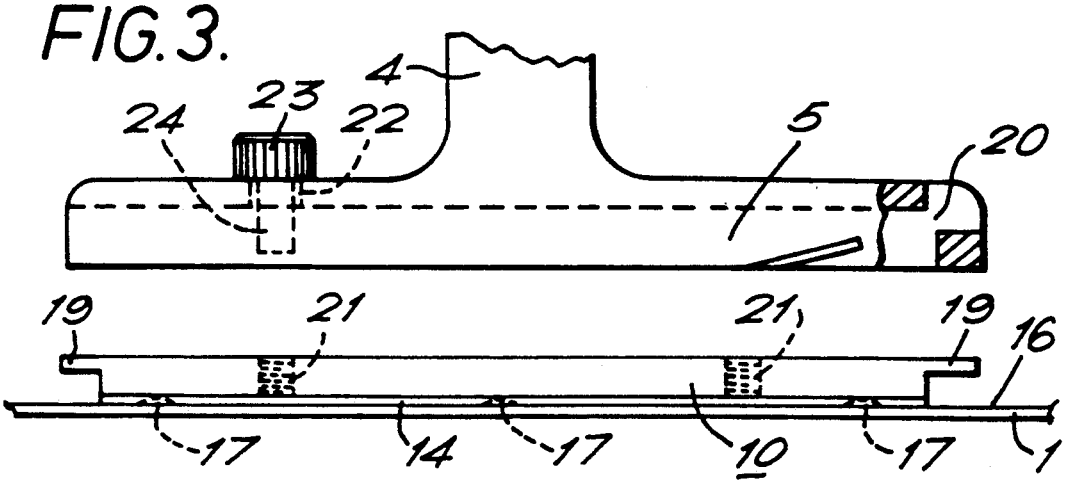
FIG. 3 is a side elevational view partially in section of components of the trowel of FIGS. 1 and 2 before connection to one another.

The smoothing trowel shown in FIGS. 1 to 3 includes a trowel blade 1, which in plan view is formed as a rectangular metal sheet of approximately 0.7 mm thickness, and a grip 2 which extends along the longitudinal axis 9 of the trowel blade 1. The grip 2 is releasably fastened to the trowel blade 1.

The grip 2 has a handle 3 which extends approximately parallel to the trowel blade 1. A grip support 4 depends from the handle 3, and a grip base 5 serves to connect with the trowel blade 1. As can be seen from FIG. 2, the grip base 5 has a U-shape in cross section. The recess formed between the two limbs 6, 7 of the grip base 5 is designated with the reference numeral 8. The recess 8 extends over the length of the grip base 5.

The grip base 5 engages over a fastening rail 10 which is fixed to the trowel blade 1. The fastening rail 10, in cross section according to FIG. 2, has a top hat shaped section. The section includes a U-shaped section with a web 11, extending parallel to the upper face 16 of the trowel blade 1, two limbs 12, 13, which extend toward the upper face 16, and flanges 14, 15 bent from the limbs 12 and 13 and extending parallel to the trowel blade 1. The fastening rail 10 lies with its flanges 14, 15 on the upper face 16 of the trowel blade 1 in an areal manner. The rail 10 is connected to the trowel blade 1 by way of rows of spot welds 17, 18 provided in the region of the flanges 14, 15, one row per flange. Over the length of the fastening rail 10, several such spot welds 17, 18 are provided per row. The spot welds 17, 18 are produced, for example, by a projection welding method. From FIG. 2 it can be seen that the spot welds 17, 18 are, in each case, arranged with clearance from the longitudinal axis 9.

Attachments 19 are fitted to the ends of the fastening rail 10. Each attachment 19 is capable of being engaged in a recess 20 of the grip base for fixing the grip 2 to the trowel blade 1. One or the other of the two attachments 19 engages in the recess 20 according to the position of the grip 2 relative to the trowel blade 1. Moreover, the fastening rail 10 has two threaded boreholes 21 arranged with clearance from one another. One or the other of the bore holes 21 is used to fix the grip 2 to the trowel blade 1 according to the position of the same opposite the grip 2. Accordingly, the grip 2 has a borehole 22 through which a knurled screw 23 with its threaded shaft 24 projects into the recess 8 of the grip base 5.

To connect the grip 2 and trowel blade 1, the grip 2 is slipped over the fastening rail 10 in such a way that one or the other of the attachments 19 projects into the recess 20. The limbs 6, 7 engage over the fastening rail 10 on its limbs 12, 13 and are supported by their end faces 26, 27 on the faces 25 of the flanges 14, 15 away from the upper face 16 of the trowel blade 1. The threaded shaft 24 of the knurled screw 23 is screwed into one of the two threaded boreholes 21 to secure the fastening rail 10 to the grip 2.

With a strain of such a kind that the trowel blade 1, with reference to FIG. 2, is supported on a base support with the outermost right edge, which can no longer be seen, there results a torque strain of the fastening of the fastening rail 10 on the trowel blade 1 about the spot welds 17 as an assumed point of rotation. It can be recognized that the spot welds 18 in this case are only strained on pull. The same applies to the supporting and loading of the left face of the trowel blade 1.

While the above detailed description describes the preferred embodiment of the present invention, the invention is susceptible to modification, variation, and alteration without deviating from the scope and fair meaning of the subjoined claims.

We claim:

1. A distributing and smoothing tool comprising:

a trowel blade, said trowel blade having a first smoothing and distributing face and a second face remote from said first face;

a fastening rail secured to said second face of said trowel blade, said fastening rail extending in a longitudinal direction of the trowel blade, said fastening rail having a top hat shape in cross section with a web facing a grip, parallel limbs extending from the web and directed towards said second face of said trowel blade and flanges extending outwardly from the ends of the limbs remote from the web, each of said flanges being welded to said second face of the trowel blade;

said grip having a base and a groove provided in said base, said groove engaged over the fastening rail and supported on the flanges of said fastening rail; and fastening means releasably fastening said grip base to said fastening rail.

2. A distributing and smoothing tool according to claim 1, wherein said grip base is supported on the flanges of said fastening rail.

3. A distributing and smoothing tool according to claim 1, wherein said flanges extend along the entire length of the fastening rail.

4. A distributing and smoothing tool according to claim 1, wherein the flanges are discontinuously welded to the trowel blade.

5. A distributing and smoothing tool according to claim 4, wherein said flanges are connected to the trowel blade by way of spaced spot welds.

6. A distributing and smoothing tool according to claim 4, wherein said flanges are projection welded to the trowel blade.

7. A distributing and smoothing tool according to claim 6, wherein said projection weld includes a seam having projections associated with the flanges of the fastening rail.

8. A distributing and smoothing tool according to claim 1, wherein said flanges are aligned parallel to said second face of the trowel blade.

9. A distributing and smoothing tool according to claim 8, wherein said flanges are in abutment with said second face of the trowel blade.

10. A distributing and smoothing tool according to claim 1, wherein said fastening means includes a screw passable through a hole in the grip base and a screw-threaded hole in the fastening rail into which the screw, passed through the hole in the grip base, is screwed to secure the grip base to the fastening rail.

* * * * *